US005667603A

United States Patent [19]

Ichikawa et al.

[11] Patent Number: 5,667,603

[45] Date of Patent: Sep. 16, 1997

[54] HARDENING PROCESS AND APPARATUS FOR HOLED FLAT PARTS

[75] Inventors: Masanori Ichikawa, Fukuroi; Tadayoshi Yoshioka, Shizuoka-ken; Katsumasa Toyoda, Ogaki; Shinichi Takizawa, Nagoya, all of Japan

[73] Assignee: NTN Corporation, Osaka, Japan

[21] Appl. No.: 523,091

[22] Filed: Sep. 1, 1995

[30] Foreign Application Priority Data

Sep. 5, 1994 [JP] Japan ..... 6-238388

[51] Int. Cl.[6] ..... C21D 9/40

[52] U.S. Cl. ..... 148/589; 148/581; 148/583; 148/585; 148/586; 148/588; 266/117

[58] Field of Search ..... 148/589, 581, 148/583, 585, 586, 588; 266/117, 118, 119

[56] References Cited

U.S. PATENT DOCUMENTS 1,233,193 7/1917 Cook ..... 266/117

FOREIGN PATENT DOCUMENTS 82746 6/1971 German Dem. Rep. ..... 266/117

*Primary Examiner*—Sikyin Ip

*Attorney, Agent, or Firm*—Lowe, Price, LeBlanc & Becker

[57] ABSTRACT

A process for hardening a plurality of holed flat parts. The holed flat parts are heated by inserting a cantilever hanger into the holes of the holed flat parts to support them in vertical positions within a furnace. The holed flat parts are then removed from the hanger by inserting a moving fork into the holes of the holed flat parts and moved to a cooling section while being supported in the vertical positions on the moving fork. Then, the holed flat parts in the vertical positions are quenched in the cooling section by blowing a gas downward to them. Also disclosed is an apparatus for practicing the holed flat part hardening process. The apparatus comprises: a continuous furnace; a plurality of stands arranged in the continuous furnace and each having a cantilever hanger; a loader including a moving fork for hanging the holed flat parts on the hanger; an extractor including a moving fork for extracting the holed flat parts from the hanger; and a cooling section for blowing a gas downward to the holed flat parts supported by the moving fork of the extractor, to quench the holed flat parts.

5 Claims, 4 Drawing Sheets

HARDENING PROCESS AND APPARATUS FOR HOLED FLAT PARTS

BACKGROUND OF THE INVENTION

1. Field of the Invention

The present invention relates to process and apparatus for hardening mechanical parts of a ring-shaped sheet such as a bearing washer for a needle roller thrust bearing, or other holed flat parts which are formed by punching a metal sheet, without being accompanied by any deformation.

2. Related Art

The annular flat parts of chromium-molybdenum steel having a thickness of about 1 mm and a diameter of about 80 mm, as used as a bearing washer of a needle thrust bearing, are so conveyed in a carburizing and hardening furnace while being loosely laid on a mesh belt conveyor, for example, according to the prior art that they are heated to about 880° C. in the carburizing atmosphere and then quenched in an oil bath.

According to the above-specified hardening process, however, the flat parts are deformed or strained, as exemplified by a warp, so that they have to be corrected to restore their original shape after the hardening operation. As a result, the number of steps increases to cause a problem that the production cost rises. With a serious deformation, the correction cannot be sufficient thereby to leave the strain, thus causing a problem that the percentage of defective products is high. Moreover, the flat parts have to be delivered into the inside of the furnace such that they are arranged without any overlap on the mesh belt. For a massive working of the flat parts, therefore, there arises another problem that the furnace has to be large-sized to require a wide space.

SUMMARY OF THE INVENTION

It is, therefore, an object of the present invention to solve the above-specified problems of the prior art.

Another object of the present invention is to provide process and apparatus for hardening the mechanical parts of a ring-shaped sheet such as a bearing washer for a needle roller thrust bearing, or other holed flat parts, without being accompanied by any deformation.

According to a first aspect of the present invention, there is provided a process for hardening a plurality of holed flat parts, which process comprises: the step of heating the holed flat parts by inserting a cantilever hanger into the holes of the holed flat parts to support the holed flat parts in vertical positions within a furnace; and the step of quenching the holed flat parts, which are removed from the hanger by inserting a moving fork into the holes of the holed flat parts and moved to a cooling section while being supported in the vertical positions on the moving fork, in the cooling section by blowing a gas downward to the holed flat parts.

In the holed flat part hardening process, water may be sprayed into the gas.

According to another aspect of the present invention, there is provided an apparatus for hardening a plurality of holed flat parts, which apparatus comprises: a continuous furnace; a plurality of stands arranged in the continuous furnace and each having a cantilever hanger; a loader including a moving fork for hanging the holed flat parts on the hanger; an extractor including a moving fork for extracting the holed flat parts from the hanger; and a cooling section for blowing a gas downward to the holed flat parts supported by the moving fork of the extractor, to quench the holed flat parts.

In the holed flat part hardening apparatus, the hanger may be formed on its upper edge with teeth for preventing the loose motions of the holed flat parts, so that it can suspend the holed flat parts in vertical positions.

In the holed flat part hardening apparatus, the moving fork of the extractor may have two fork members having a low heat capacity and arranged in parallel at a predetermined gap, and the fork members may be formed on their upper edges with teeth for preventing the loose motions of the holed flat parts so that they can suspend the holed flat parts in vertical positions.

Since the holed flat parts are heated in the vertical positions, they are hard to deform, even if their material softens. Since, moreover, the gas is blown downward the parts in the vertical positions, they are prevented from loosely moving by the wind pressure so that they can be prevented from being deformed. With the spray of water, still moreover, the cooling rate can be further increased. In addition, a number of holed flat parts can be suspended from the hanger so that a large space is not needed. Furthermore, the cooling operation can be facilitated because the holed flat parts are transferred onto the moving fork having a small heat capacity.

DESCRIPTION OF THE PREFERRED EMBODIMENT

Figure 1:
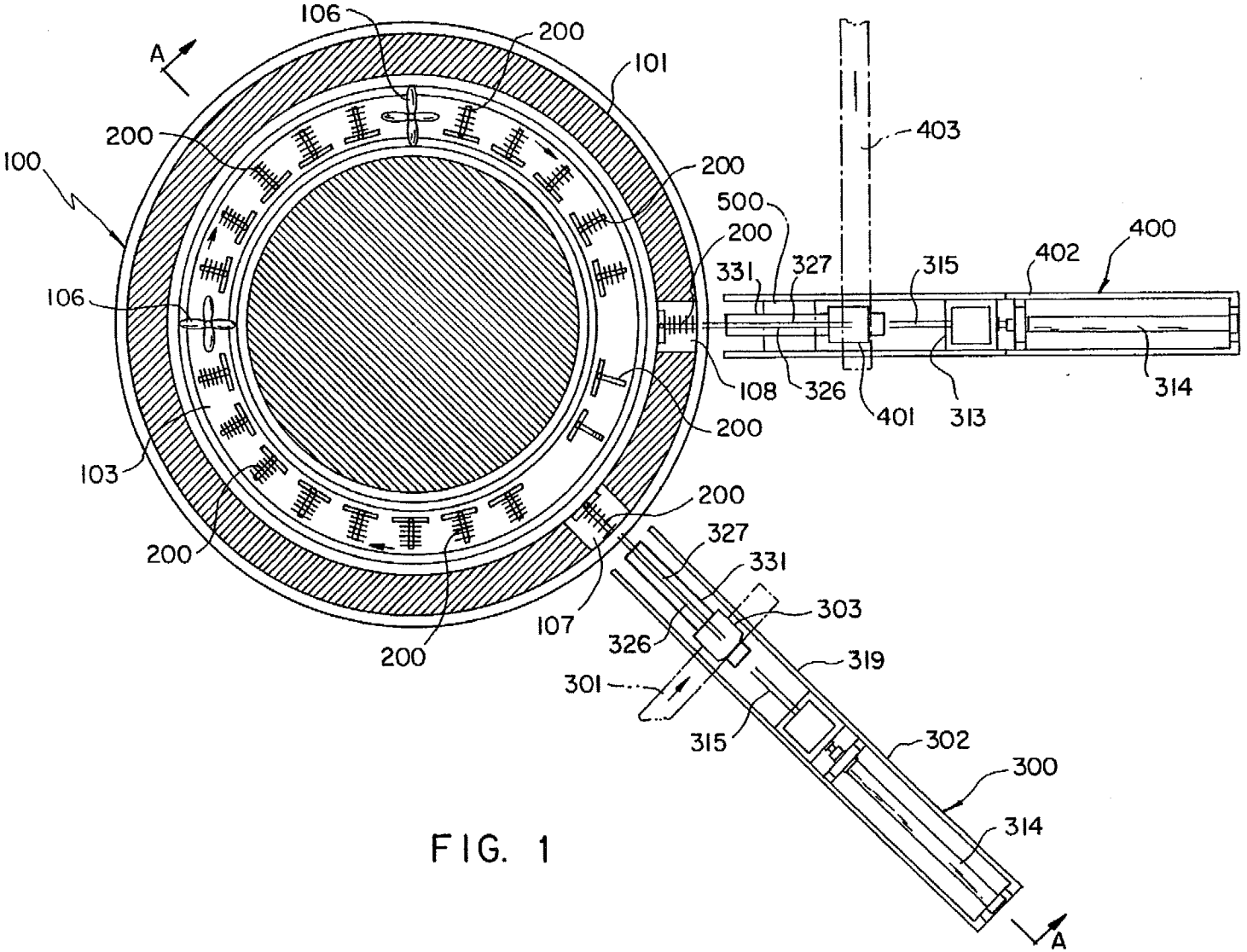
FIG. 1 is a horizontally sectional top plan view of a hardening apparatus according to the present invention.
Figure 2:
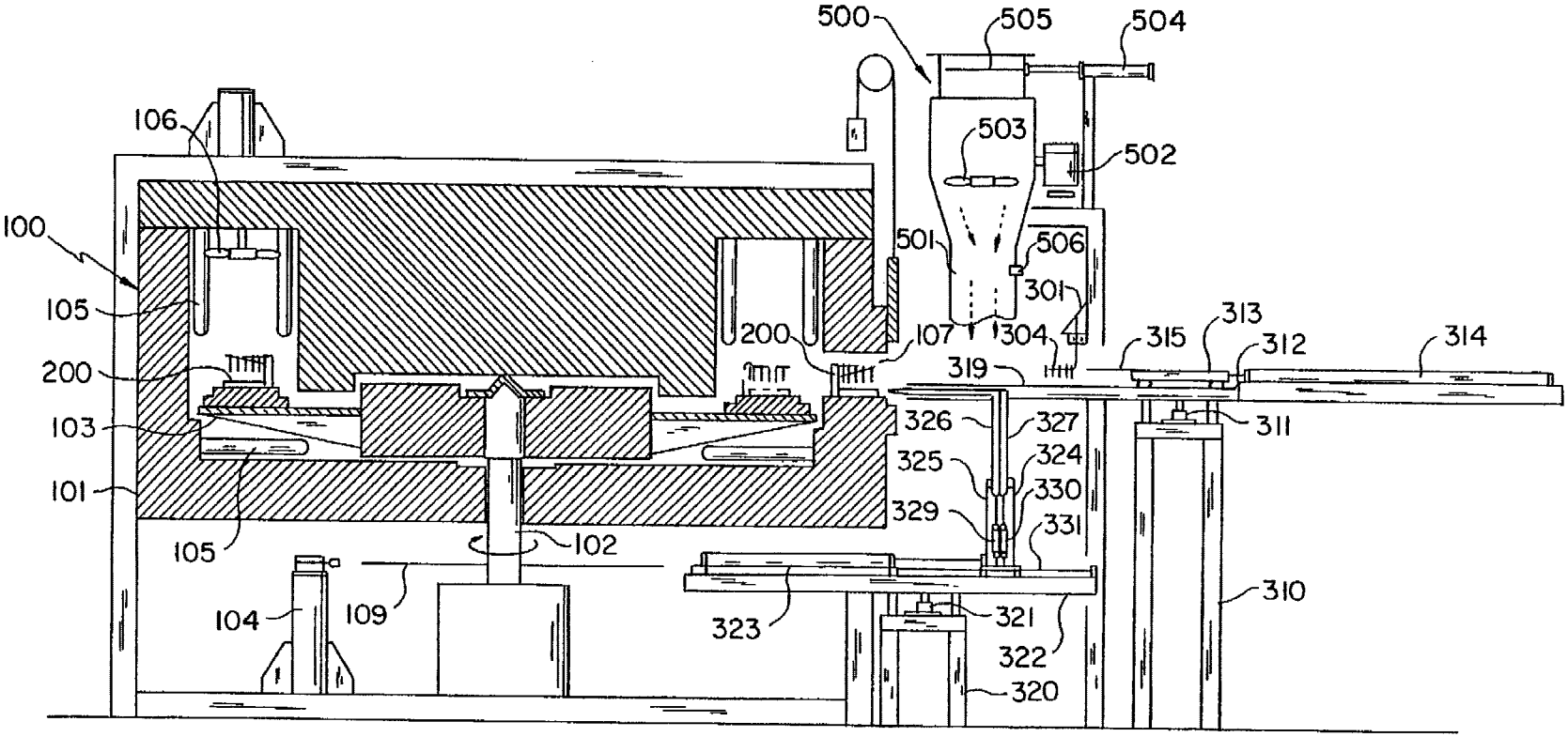
FIG. 2 is a section taken along line A—A of FIG. 1.
Figure 3:
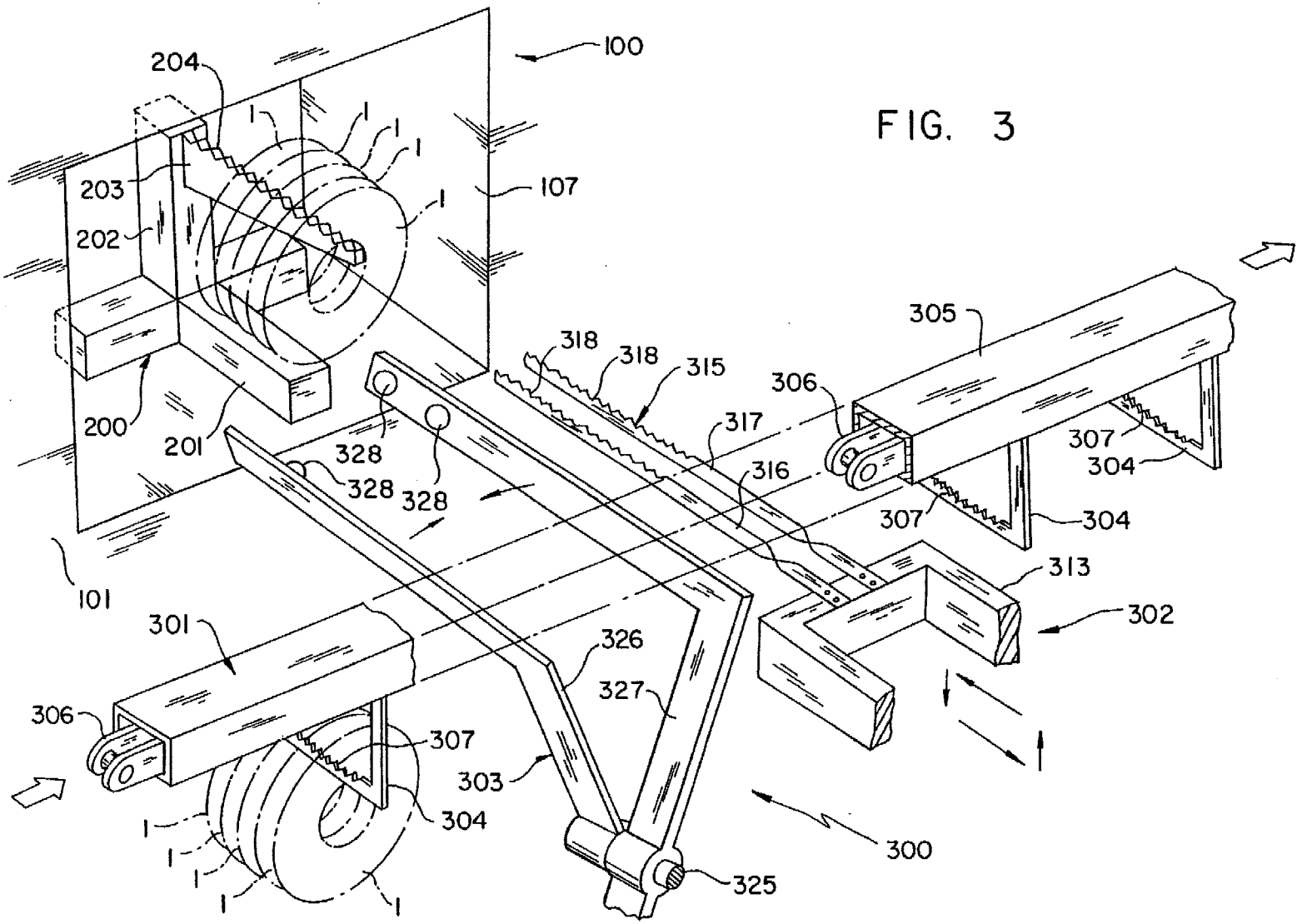
FIG. 3 is a perspective view showing the neighborhood of the charging hole of a furnace body of FIG. 1.

One embodiment of the present invention will be described in the following with reference to the accompanying drawings. FIG. 1 is a top plan view showing a hardening apparatus which is constructed to include a continuous furnace 100 for practicing a hardening process of the present invention, stands 200, a loader 300, an extractor 400 and a cooling section 500. The continuous furnace 100 is a rotary hearth type gas carburizing furnace and is equipped, as shown in FIG. 2, with a turn table 103 which is so supported by a rotating shaft 102 over the floor of a cylindrical furnace body 101 that it is rotated at a low speed in the direction of arrow by a motor. Reference numeral 104 designates a cam stopper which engages with a disc 109 fixed on the rotating shaft 102 for interrupting the turn table 103 when this table 103 rotates a predetermined angle. Numeral 105 designates radiant tube burners arranged in the furnace body 101, numeral 106 an in-furnace fan disposed in the furnace ceiling, numeral 107 a charging hole opened in the outer wall of the furnace body 101, and numeral 108 an extracting hole opened likewise. Incidentally, the furnace body 101 has its inside fed with a carburizing atmospheric gas.

Each of the stands 200, as placed on the turn table 103, is constructed by erecting a strut 202 on a T-shaped body 201 and by attaching a cantilever hanger 203 to the upper end of the strut 202. Incidentally, the hanger 203 is formed on its upper edge with teeth 204 having a predetermined pitch. Reference numeral 1 designates holed flat parts which are punched into a ring shape having a diameter of about 80 mm by pressing a thin metal sheet (of chromium-molybdenum steel) having a thickness of about 1 mm to be worked. A plurality of these holed flat parts 1 can be so loaded at a predetermined pitch by the later-described loader 300 that they can be supported in a vertically suspended position by the hanger 203. In this case, the aforementioned teeth 204 prevent the holed flat parts 1 from loosely moving thereby to arranged the parts 1 at a predetermined interval.

The loader 300 is constructed to include: a main manipulator 302 for taking the holed flat parts 1 being conveyed by a trolley conveyor 301, out of a suspending bar 304 of the trolley conveyor 301 to hang the taken parts 1 from the hanger 203 of the stand 200 positioned in the charging hole 107; and an auxiliary manipulator 303 for gripping and transferring the stand 200 onto the turn table 103. The trolley conveyor 301 is constructed by attaching the L-shaped suspending bars 304 at a predetermined interval to an endless chain 306 running in the direction of arrow in a rail 305, and each of the suspending bars 304 suspends a plurality of holed flat parts 1 in a vertical position. Moreover, the suspending bar 304 is formed on its upper edge with teeth 306 for holding the holed flat parts 1 in the notches to prevent the parts 1 from being fluctuated by vibrations or the like so that it can suspend the holed flat parts 1 at a predetermined pitch at all times.

The main manipulator 302 is arranged with an elevator 312 which is moved upward and downward by a cylinder 311 of a small stroke mounted upright on a frame 310. A square-framed sliding member 313 is made slidable along a rail 319 which is laid on the elevator 312. The sliding member 313 can be protruded to and retracted from the charging hole 107 by the action of a cylinder 314 which is fixed to the back of the elevator 312. The sliding member 313 is equipped at its front edge with a moving fork 315. This moving fork 315 is so fixed to the sliding member 313 that two slender fork members 316 and 317 made of a refractory metallic thin sheet and having a small heat capacity are supported in parallel at a predetermined spacing. These fork members 316 and 317 are formed on their upper edges close to the leading ends with two ridges of teeth 318 similar to the aforementioned teeth 307.

Moreover, the auxiliary manipulator 303 is arranged with an elevator 322 which is moved upward and downward by a cylinder 321 of a small stroke mounted upright on a frame 320. A manipulator body 324 is so disposed over the elevator 322 that it can be moved back and forth on a rail 331 by the action of a cylinder 323. The manipulator body 324 has its paired arms 326 and 327 so hinged by a pin 325 that it can be freely opened and closed. These arms 526 and 327 have their upper portions folded in a horizontal direction toward the charging hole 107, as shown in FIG. 8. The leading end portions of the arms 326 and 327 are formed on their confronting inner faces with slide stopping projections 328. The arms 326 and 327 are equipped at their lower end portions with cylinders 329 and 330 for acting to open and close the arms 326 and 327. As a result, the aforementioned stand 200 can be gripped by the projections 328 at the leading end portions of the arms 326 and 327 until it can be loaded onto the turn table 103 by the action of the cylinder 323.

On the other hand, the extractor 400 is constructed to include an auxiliary manipulator 401 for gripping the stand 200, which has been carried circumferentially in the direction of arrow within the furnace by the turn table 103, to transfer it to the extracting hole 108, and a main manipulator 402 for extracting the holed flat parts 1 from the hanger 203 of the stand 200 to hang the extracted parts 1 on the (not-shown) suspending bar of a trolley conveyor 403. Here: the auxiliary manipulator 401 is given a construction identical to that of the aforementioned auxiliary manipulator 303; the main manipulator 402 is given a construction identical to that of the aforementioned main manipulator 302; and the trolley conveyor 403 is given a construction identical to that of the aforementioned trolley conveyor 301. Hence, the detailed description of the structures of these identical portions will be omitted by designating them at the common reference numerals.

Figure 4:
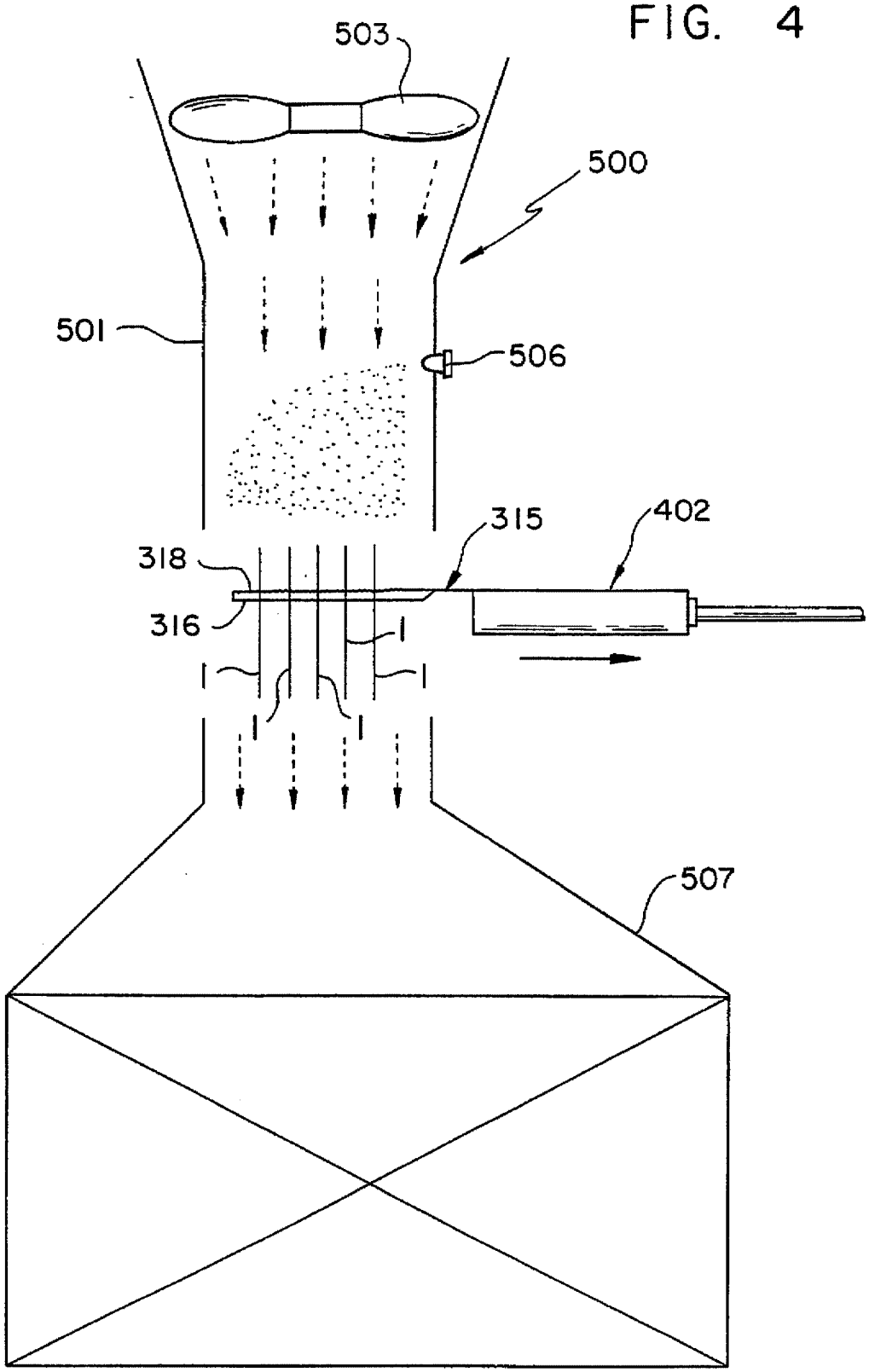
FIG. 4 is an enlarged longitudinal section showing a cooling section of FIG. 1.

The cooling section 500 is constructed, as also shown in FIG. 4, by disposing a blower duct 501 upright over the path of the main manipulator 402 for carrying the holed flat parts 1, by equipping the blower duct 501 therein with a fan 503 to be rotated by a motor 502, and by equipping the upper open end of the blower duct 501 with a shutter 505 to be opened and closed by a cylinder 504. Moreover, the blower duct 501 is equipped in its one side wall with a nozzle 506 for spraying water into the blower duct 501. Incidentally, reference numeral 507 designates an exhaust hood disposed below the blower duct 501.

In the hardening apparatus thus constructed, the suspending bar 304 suspending the holed flat parts 1 in the vertical positions is stopped in front of the charging hole 107. The moving fork 315 is advanced from the back of the main manipulator 302 into the holes of the holed flat parts 1 by the action of the cylinder 314 until it is stopped when the suspending bar 304 is positioned between the fork members 316 and 317. Then, the moving fork 315 is slightly elevated by the cylinder 311 to transfer the holed flat parts 1 onto the fork members 316 and 317. After this, the moving fork 315 is further advanced into the charging hole 107, and the hanger 203 of the stand 200 is positioned and stopped between the fork members 316 and 317. Then, the cylinder 311 is contracted to lower the moving fork 315 slightly thereby to transfer the holed flat parts 1 onto the hanger 203. Next, the stand 200 is gripped by the arms 326 and 327 and is transferred onto the turn table 103 by bringing the manipulator body 324 close to the charging hole 107 by the action of the cylinder 323.

The holed flat parts 1 thus charged into the furnace body 101 are heated to about 880° C. in the carburizing atmospheric gas by the radiant tube heater 105 while the turn table 103 turns in the arrow direction. When the holed flat parts 1 come to the extracting hole 108, the arms 326 and 327 of the auxiliary manipulator 401 are inserted into the furnace to grip and carry the stand 200 to the extracting hole 108. Then, the moving fork 315 is advanced into the holes of the holed flat parts 1 of the stand 200 placed in the extracting hole 108 and is slightly elevated to receive the holed flat parts 1. Then, the cylinder 314 is contracted to retract the moving fork 315 until the moving fork 315 comes to just below the blower duct 501. Then, the shutter 505 is opened to blow the air downward into the blower duct 501 thereby to quench the holed flat parts 1. Since the cool air is thus blown downward onto the holed flat parts 1 suspended in the vertical positions by the moving fork 315, the holed flat parts 1 can be quenched to about 200° C. for 20 to 30 seconds, while being regularly held in their suspended positions without being moved by the wind pressure, so that they can be hardened to a desired hardness. Here, the gas for quenching the holed flat parts may be exemplified not only by the air but also by a nitrogen gas or an inert gas. Alternatively, the holed flat parts may be cooled by a cooler or the like, as the case may be. Moreover, the means for supporting the holed flat parts 1 in the vertical positions should not he limited to that of the foregoing embodiment but may be exemplified by means for supporting the inner walls of the holed flat parts 1 at a plurality of points by weak spring forces.

At this cooling time, moreover, the holed flat parts 1 are transferred to and supported by the moving fork 315 having a low heat capacity, and this moving fork 315 is held at substantially normal temperatures. As a result, the moving fork 315 hardly exerts thermal influences upon the holed flat parts 1 so that the parts 1 can be quenched.

Since, moreover, the water is sprayed from the nozzle 506 into the blower duct 501 so that it is blown together with the gas onto the holed flat parts 1, the cooling rate can be substantially doubled by making use of the heat of vaporization. The holed flat parts 1 thus hardened are suspended and delivered by the suspending bar 304 of the trolley conveyor 403 by further retracting the moving fork 315.

Thus according to the hardening process of the present invention, the holed flat parts are heated to a desired high temperature by supporting them in the vertical positions on the hanger. After this heating step, the holed flat parts are removed from the hanger and supported in the vertical positions on the moving fork so that they are quenched by blowing the gas downward onto them. As a result, the weights of the holed flat plates are vertically applied not only during the heating operation but also during the cooling operation. Thus, the highly precise hardened parts can be easily manufactured without any fear of the deformation which might otherwise be caused by the prior art in which the parts are loosely laid on the mesh belt. Moreover, the hardening apparatus of the present invention is effective in that a number of holed flat parts can be continuously worked with a high productivity and in that no wide space is required for installing the hardening apparatus. Moreover, there is no need for the cooling agent such as oil so that the post-step such as a rinsing step can be omitted.

What is claimed is:

1. A process for hardening a plurality of holed flat parts, comprising:

a) providing a plurality of flat parts having opposing sides and a hole therethrough;

b) providing a cantilevered hanger having a support surface;

c) inserting the cantilevered hanger through the holes of said plurality of flat parts so that inner surfaces of said holes rest on the support surface so that the opposing sides of each flat part are generally vertically aligned;

d) heating each flat part while each flat part rests on the support surface in a heating zone;

e) removing each said flat part from said support surface and said heating zone and repositioning each said flat part in a cooling section in a generally vertical alignment; and f) cooling each said flat part by blowing a cooling gas in a vertically downward direction past each said flat part.

2. The process of claim 1 wherein said cooling gas includes a water spray.

3. The process of claim 1 wherein said removing step utilizes a moving fork for removal of each said flat part from said support surface and said heating zone.

4. The process of claim 1 wherein the cantilevered hanger is provided with a plurality of steps on said support surface, each step sized to support a respective said flat part.

5. The process of claim 1 wherein said flat part is annular.

* * * * *